US007888614B2

(12) United States Patent
Pippel et al.

(10) Patent No.: US 7,888,614 B2
(45) Date of Patent: Feb. 15, 2011

(54) CONTROL PANEL ASSEMBLY

(75) Inventors: Bradley J. Pippel, Grandville, MI (US); Terry L. Lautzenheiser, Nunica, MI (US); Thomas A. Niezgoda, Kentwood, MI (US)

(73) Assignee: Access Business Group International LLC, Ada, MI (US)

( * ) Notice: Subject to any disclaimer, the term of this patent is extended or adjusted under 35 U.S.C. 154(b) by 0 days.

(21) Appl. No.: 12/607,327

(22) Filed: Oct. 28, 2009

(65) Prior Publication Data

US 2010/0096246 A1 Apr. 22, 2010

Related U.S. Application Data

(62) Division of application No. 11/457,007, filed on Jul. 12, 2006, now Pat. No. 7,629,548.

(60) Provisional application No. 60/699,162, filed on Jul. 14, 2005.

(51) Int. Cl.
*H01H 21/04* (2006.01)

(52) U.S. Cl. ..... 200/314; 362/95

(58) Field of Classification Search ..... 200/310–317; 362/95

See application file for complete search history.

(56) References Cited

U.S. PATENT DOCUMENTS

| | | | | | |
|---|---|---|---|---|---|
| 506,729 | A * | 10/1893 | Rex | 200/314 |
| 1,489,087 | A * | 4/1924 | McKinley | 315/130 |
| 2,293,382 | A * | 8/1942 | Case et al. | 337/66 |
| 2,491,914 | A * | 12/1949 | Anderson | 340/321 |
| 3,309,697 | A | 3/1967 | Skrbina | |
| 3,943,352 | A * | 3/1976 | Pena May | 362/501 |
| 5,036,440 | A * | 7/1991 | Takii et al. | 362/95 |
| 5,536,543 | A * | 7/1996 | Papandreou | 428/35.7 |
| 5,718,326 | A * | 2/1998 | Larose et al. | 200/314 |
| 5,850,062 | A * | 12/1998 | Botz et al. | 200/315 |
| 5,993,019 | A * | 11/1999 | Kline et al. | 362/29 |
| 6,809,273 | B2 * | 10/2004 | Ito et al. | 200/5 R |
| 7,104,677 | B2 * | 9/2006 | Barlian et al. | 362/545 |
| 7,244,898 | B2 * | 7/2007 | Kim | 200/314 |
| 2005/0189205 | A1 | 9/2005 | Fujii et al. | |
| 2005/0194241 | A1 | 9/2005 | Kim | |
| 2005/0274593 | A1 | 12/2005 | Kawano | |
| 2006/0016676 | A1 * | 1/2006 | Jung | 200/314 |

* cited by examiner

*Primary Examiner*—Renee Luebke
*Assistant Examiner*—Sean Kayes
(74) *Attorney, Agent, or Firm*—Warner Norcross & Judd LLP

(57) ABSTRACT

An illuminated control button with an eccentric switch and a button spring configured to substantially balance the mechanical resistance of the switch when the button is depressed. The switch may be a conventional push-button switch having a stem directly contacting a portion of the control button. The button spring may include an integral reflector and may have a rim that defines a surface engaging the button. The control button may include a fixed light source and the reflector may move about the light source when the control button is depressed. The present invention also provides a control button with a light source at least partially contained within an integrating sphere. In one embodiment, the integrating sphere includes a somewhat cup-shaped diffusely reflective surface that cooperates with a diffusely reflective surface on the back surface of the button to substantially evenly distribute light from the light source throughout the integrating sphere.

10 Claims, 12 Drawing Sheets

CONTROL PANEL ASSEMBLY

The present application is a divisional of U.S. application Ser. No. 11/457,007, filed Jul. 12, 2006, which claims the benefit of U.S. Provisional Application No. 60/699,162 filed Jul. 14, 2005.

BACKGROUND OF THE INVENTION

The present invention relates to control panels and more particularly to illuminated electronic control panels.

Illuminated control buttons are in wide spread use. A conventional control button includes a light source and a switch. A transparent or translucent window is typically formed in the button in the form of an icon, letter(s), number(s) or other symbols. Often, the light source (such as an LED) and switch (such as a push-button micro switch) are mounted to a circuit board positioned below the control button. It is desirable to center the switch on the button so that when the button is depressed, the mechanical resistance of the switch does not cause the button to cant or twist. If the button is off-center, pushing the center of the control button may cause the button to tilt about the mechanical switch. This tilting reduces the aesthetic feel of the control button and may cause the control button to bind, thereby preventing smooth operation. It is also desirable to center the light source below the button so that the illumination appears centered on the button. An off-center light source may cause a portion of the window to glow more brightly than other portions. This may reduce the aesthetic appeal of the button and may make is difficult to see the entire symbol.

As can be seen, there is a desire to mount both the switch and the light source at the center of the control button. Unfortunately, a conventional control button assembly does not provide sufficient space for both the switch and the light source to be mounted at the center of the control button.

SUMMARY OF THE INVENTION

The present invention provides an illuminated control button with an eccentric switch and a button spring configured to substantially balance the mechanical resistance of the switch when the button is depressed.

In one embodiment, the switch is a conventional push-button switch having a stem directly contacting a portion of the control button. In this embodiment, the button spring may include a seat directly engaging the button and plurality of spring arms that are arranged around the seat in a configuration that balances the mechanical resistance of the switch. The spring arms may be replaced by other spring elements, such as rubber bands extending between the button and the control panel or elastic feet extending from the circuit board.

In another embodiment, the button spring includes an integral reflector. The reflector may be integral with the seat, for example, having a rim that defines a surface engaging the button.

In one embodiment, the control button includes a light source located at the approximate center of the button. The light source may be a conventional LED. The LED (or other light source) may be fixed and the reflector may move about the light source when the control button is depressed, for example, as with the above described embodiment in which the reflector is integral with the button spring. The light source may be mounted to a circuit board and may be cylindrical extending along an axis coincident with the direction of travel of the control button.

In a second aspect, the present invention provides a control button with a light source at least partially contained within an integrating sphere. In one embodiment, the integrating sphere includes a somewhat cup-shaped diffusely reflective surface that cooperates with a diffusely reflective surface on the back surface of the button to substantially evenly distribute light from the light source throughout the integrating sphere.

In one embodiment, the control button includes a translucent window through which light from within the integrating sphere can be seen. The translucent window may be set within an otherwise opaque button, and may be shaped to define an icon, letter(s), number(s), word(s) or other symbols. This configuration may be essentially reversed with the symbol being substantially opaque and the remaining visible portion of the button being transparent.

In another embodiment, at least portions of the integrating sphere are integrated into the button spring. In one embodiment, the integrating sphere includes a cup-shaped diffusely reflective surface that is integral with the button spring. The reflective surface may include a rim that defines a surface interfacing with the button.

The present invention provides a button assembly that provides uniform and balanced actuation even with a substantially eccentric switch. In applications with a light source, the present invention permits a largely centered light source resulting in largely uniform light distribution over the button window. In applications incorporating an integrating sphere, diffuse light distribution is further improved.

These and other objects, advantages, and features of the invention will be readily understood and appreciated by reference to the detailed description of the current embodiment and the drawings.

DESCRIPTION OF THE CURRENT EMBODIMENT

A control button assembly in accordance with one embodiment of the present invention is shown in FIGS. 1-12. The present invention is described in connection with a control panel assembly 10 (See FIG. 1) for an air treatment system (not shown). The present invention is, however, not restricted to use with air treatment systems. Rather, the present invention can be readily incorporated into the controls of essentially any type of system.

Figure 1:
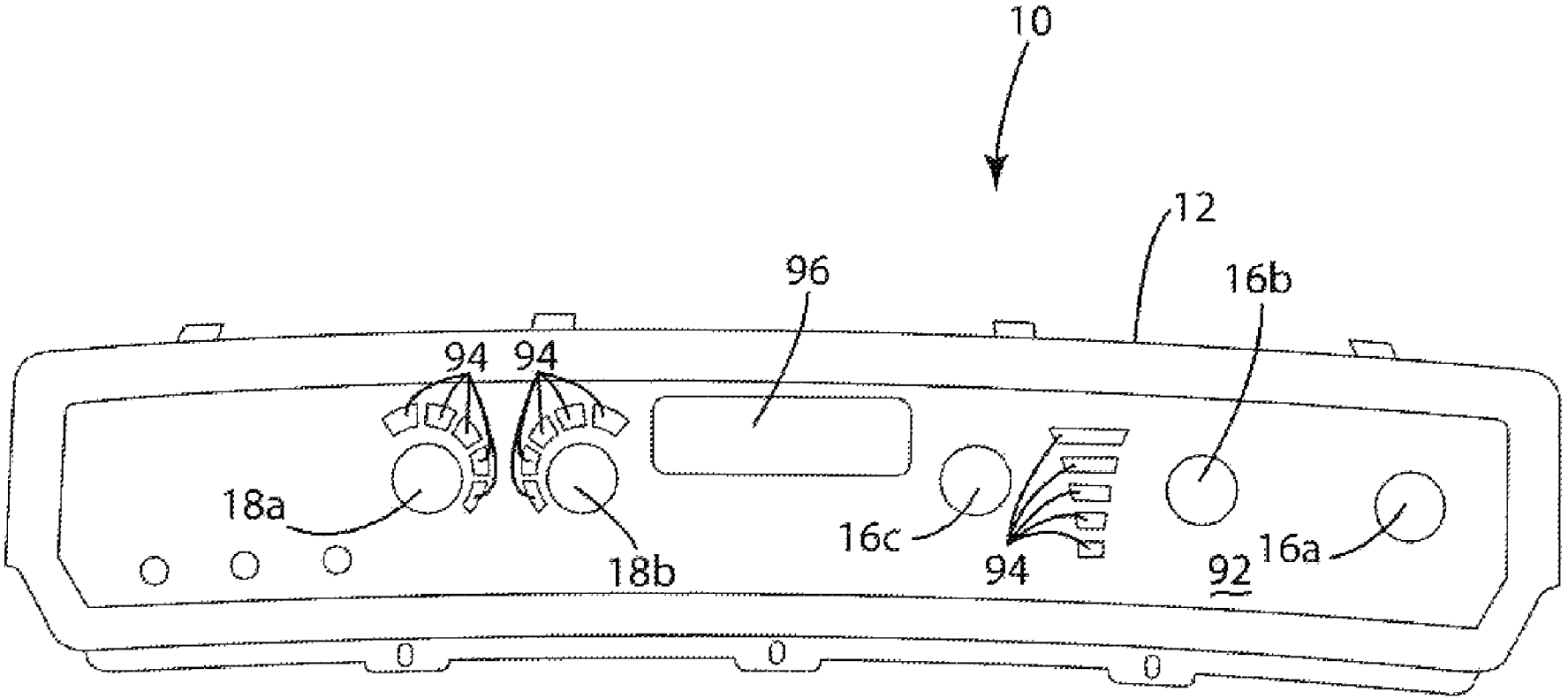
FIG. 1 is a photograph of the front of a control panel assembly in accordance with one embodiment of the present invention.
Figure 2:
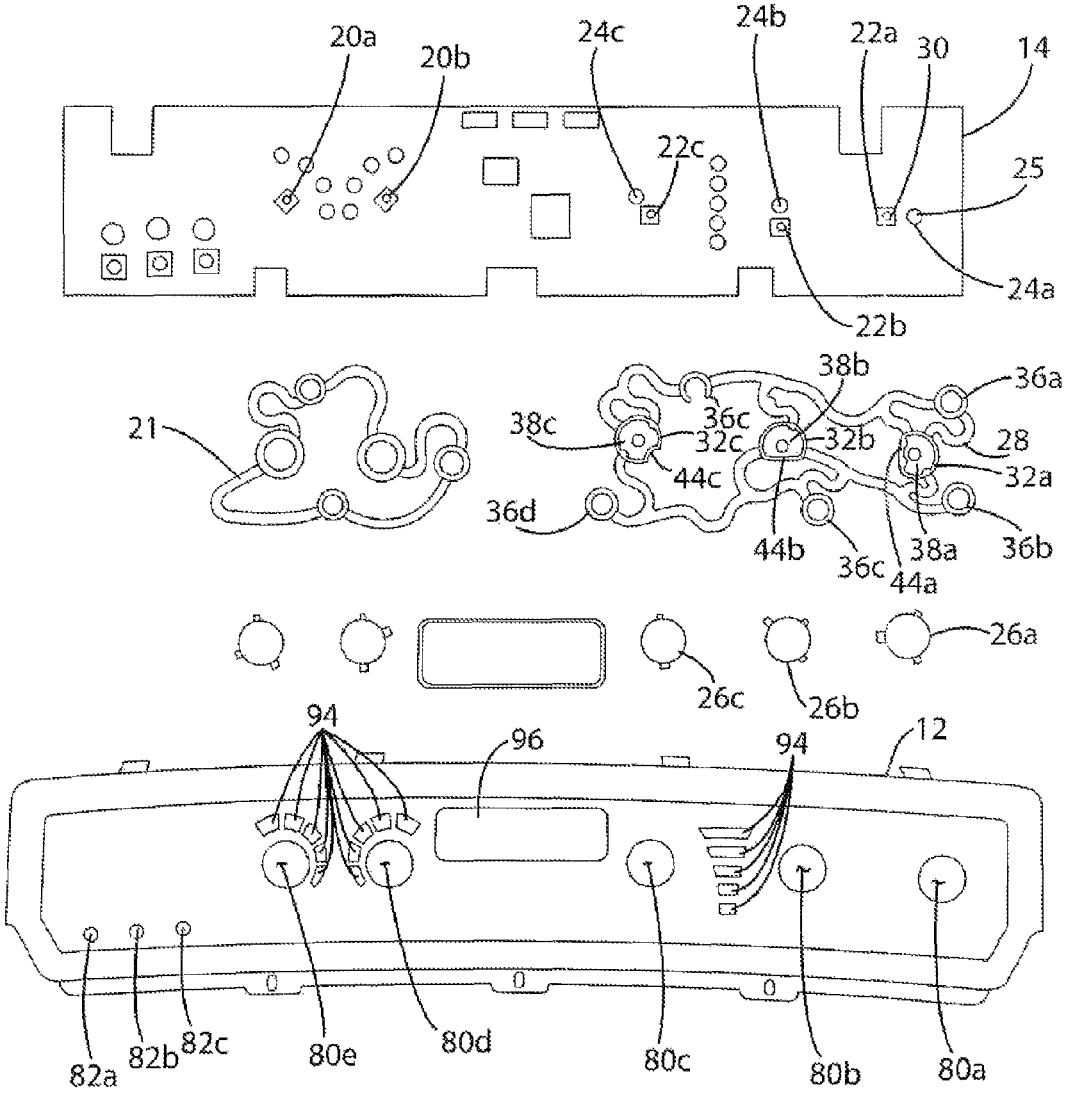
FIG. 2 is a photograph of a partially disassembled control panel separately showing some of the general components.
Figure 3:
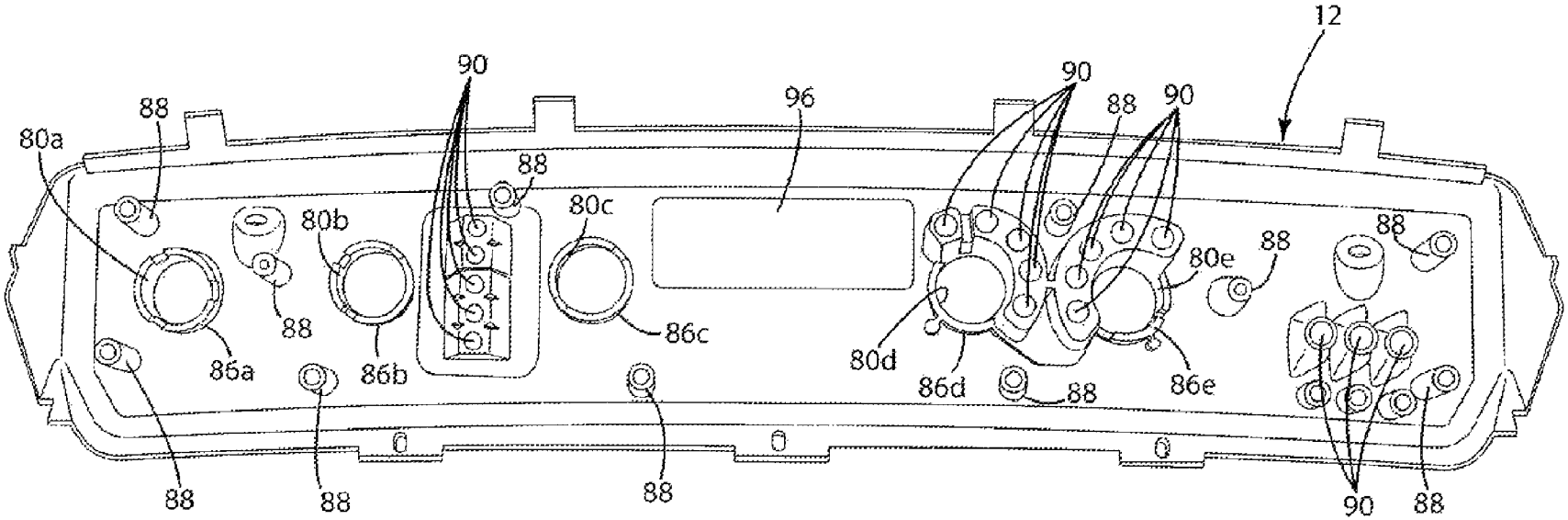
FIG. 3 is a photograph of the rear of the control panel.
Figure 4:
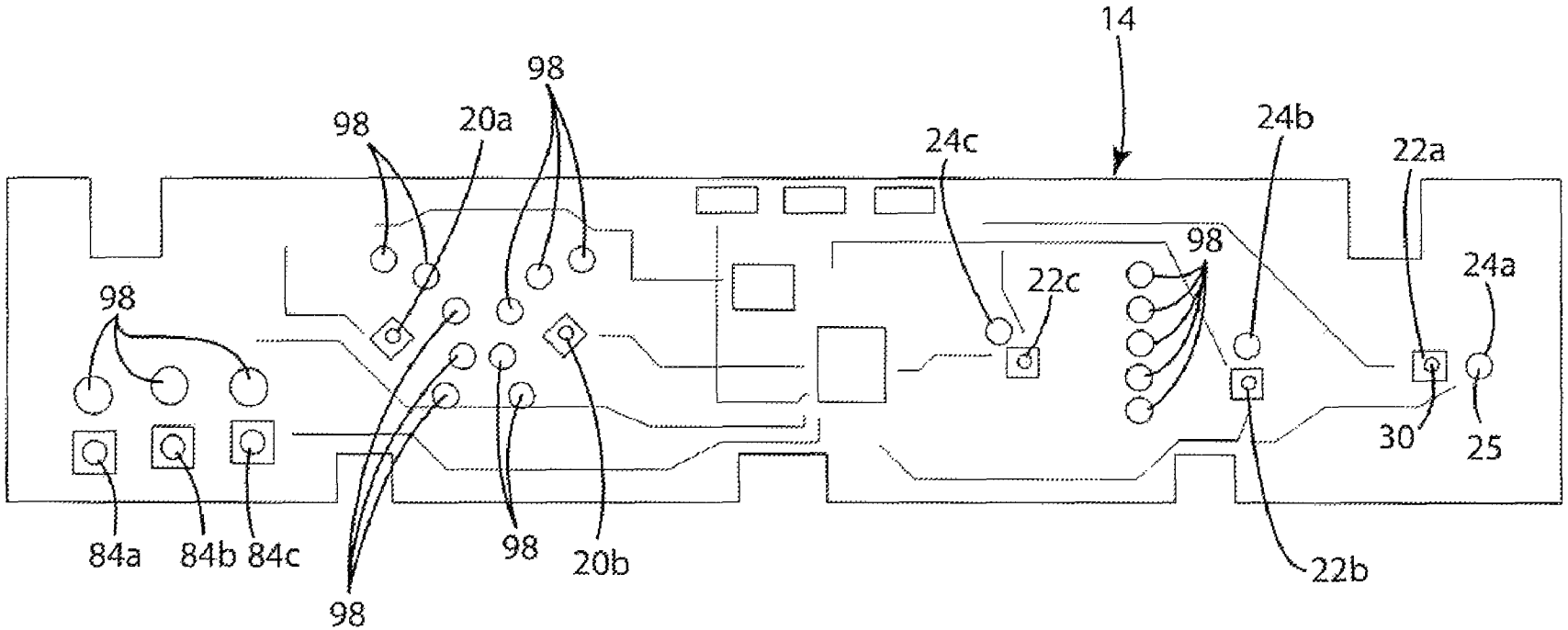
FIG. 4 is a photograph of the front of the circuit board.
Figure 5:
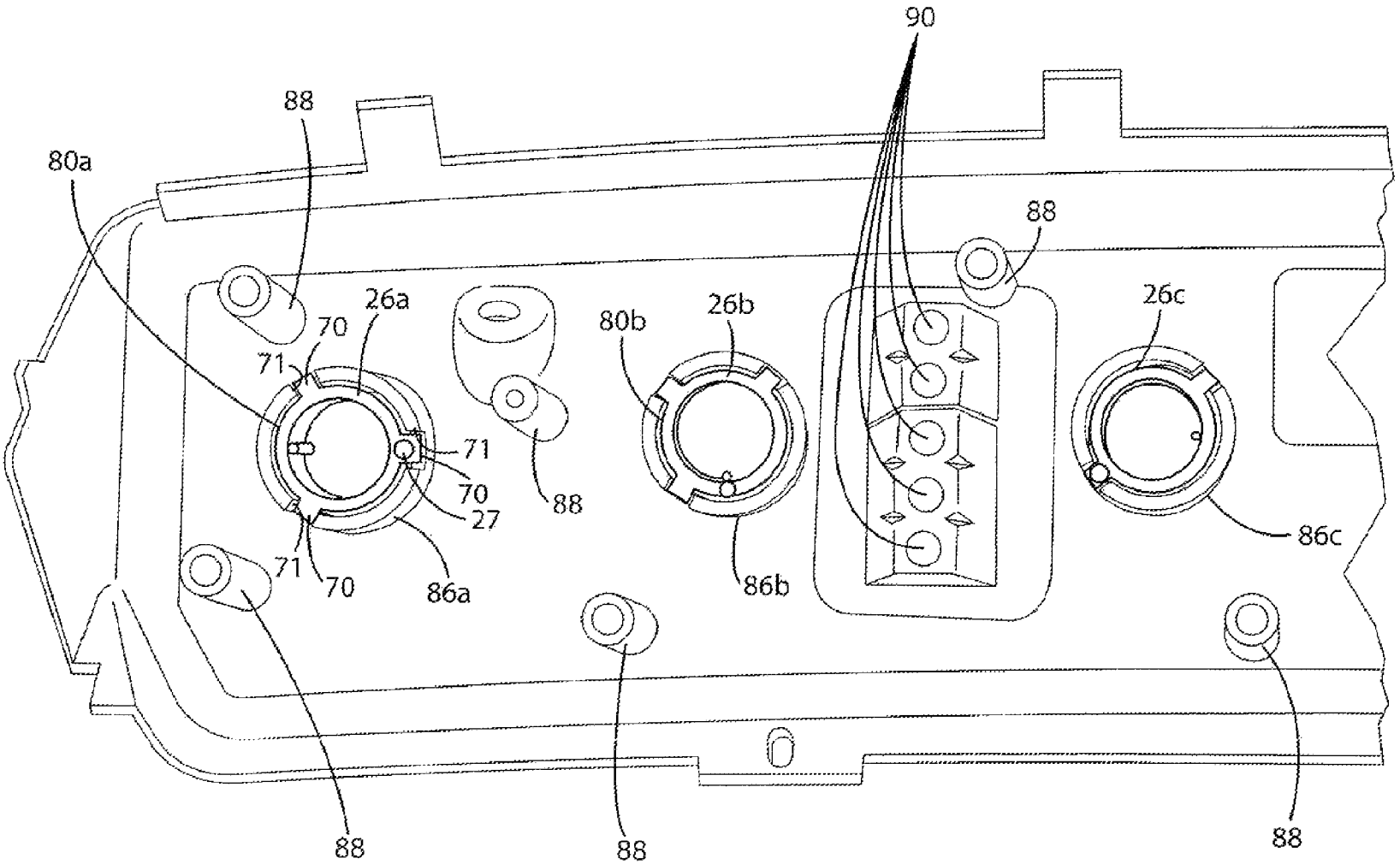
FIG. 5 is an enlarged photograph of a portion of the rear of the control panel with the buttons installed.

The control panel assembly 10 generally includes a control panel 12, a circuit board 14 and a plurality of control button assemblies 16*a-c* and 18*a-b* (See FIGS. 1 and 2). In the illustrated embodiment, the control panel 12 is generally conventional. As perhaps best shown in FIG. 2, the control panel 12 defines a plurality of button openings 80*a-e* configured to receive the various button assemblies 18*a-b* and 16*a-c*. The control panel 12 also defines a plurality of reset openings 82*a-c* that provide access to filter reset switches 84*a-c* mounted to the circuit board 14 behind the control panel 12 (FIG. 4). Referring now to FIG. 3, the control panel 12 includes a rearwardly extending collar 86*a-e* surrounding each of the button openings 80*a-e*, a plurality of rearwardly extending screw bosses 88 and a plurality of rearwardly extending LED sleeves 90. In the illustrated embodiment, the front surface of the control panel 12 is covered by a decal 92 containing various text, symbols and various translucent portions 94 that are illuminated by LEDs mounted to circuit board 14. The control panel 12 may also include an infrared window 96 to permit signals from an infrared remote control (not shown) to pass through the control panel 12 to an infrared sensor (not labeled) mounted on the circuit board 14. The design and configuration of the control panel 12 may vary from application to application.

The circuit board 14 of the illustrated embodiment is also generally conventional, and therefore will not be described in detail. The circuit board 14 is mounted to the rear surface of the control panel 12. The circuit board 14 hold a variety of electronic components, including switches 20*a-b* and 22*a-c*, button assembly LEDS 24*a-c* and various other LEDs 98. As described in more detail below, the circuit board 14 also traps the buttons 26*a-c* and button spring 28 in place behind the control panel 12.

As perhaps best shown in FIG. 1, the control panel assembly 10 of the illustrated embodiment includes five control button assemblies, including three button assemblies 16*a-c* that are illuminated and two button assemblies 18*a-b* that are not illuminated. Button assemblies 18*a-b* are generally conventional and each includes a centrally located switch 20*a-b* mounted to circuit board 14 (See FIGS. 2 and 4). The centrally located switches 20*a-b* provide these button assemblies 18*a-b* with an even, balanced feel. Accordingly, these button assemblies 18*a-b* can incorporate a generally conventional button spring 21 (See FIG. 2). Because button assemblies 18*a-b* are generally conventional, they will not be described in detail in this application.

As noted above, button assemblies 16*a-c* are illuminated. Button assemblies 16*a-c* are generally identical and therefore will be described primarily with reference to only illuminated button assembly 16*a*. Button assembly 16*a* generally includes a switch 22*a*, an LED 24*a*, a button 26*a* and a button spring 28. In this embodiment, the button assembly 16*a* is mounted behind the control panel 12 over circuit board 14. Accordingly, the switch 22*a* and the LED 24*a* may be mounted directly to the circuit board 14. These components need not, however, be mounted to a circuit board, and may be mounted to other support structures as desired. The switch 22*a* of this embodiment is a conventional push-button micro switch that is soldered directly to the circuit board 14. The switch 22*a* includes a stem 30 that extends into engagement with the button 26*a* (See FIG. 12). In this embodiment, the stem 30 engages the rear surface 27 of the button 26 at the rearward extent of circumferential wall 66 (described below). The switch 22*a* may be replaced by alternative types of switches, as desired. In this embodiment, the LED 24*a* is a conventional 5 mm light emitting diode that is soldered directly to circuit board 14. As shown, the LED 24*a* includes a generally cylindrical light emitting portion 25 that is arranged to extend in the direction of button travel (i.e. the direction the button moves when it is depressed). As described in more detail below, this permits the reflector to move with respect to the LED 24*a* as the button 26 is actuated. The size and type of LED may vary from application to application as desired. The LED 24*a* may be replaced by essentially any light source satisfying the application specific parameters, such as incandescent lighting, electron discharge lighting and light emitting polymers. However, not all of these alternative light sources may provide the same level of performance with an integrating sphere. In this embodiment, the LED 24*a* is positioned at the approximate center of the button 26. As a result, the button assembly 16*a* enjoys the aesthetic and functional benefit of having a light source centered on the button 26*a*.

Figure 9:
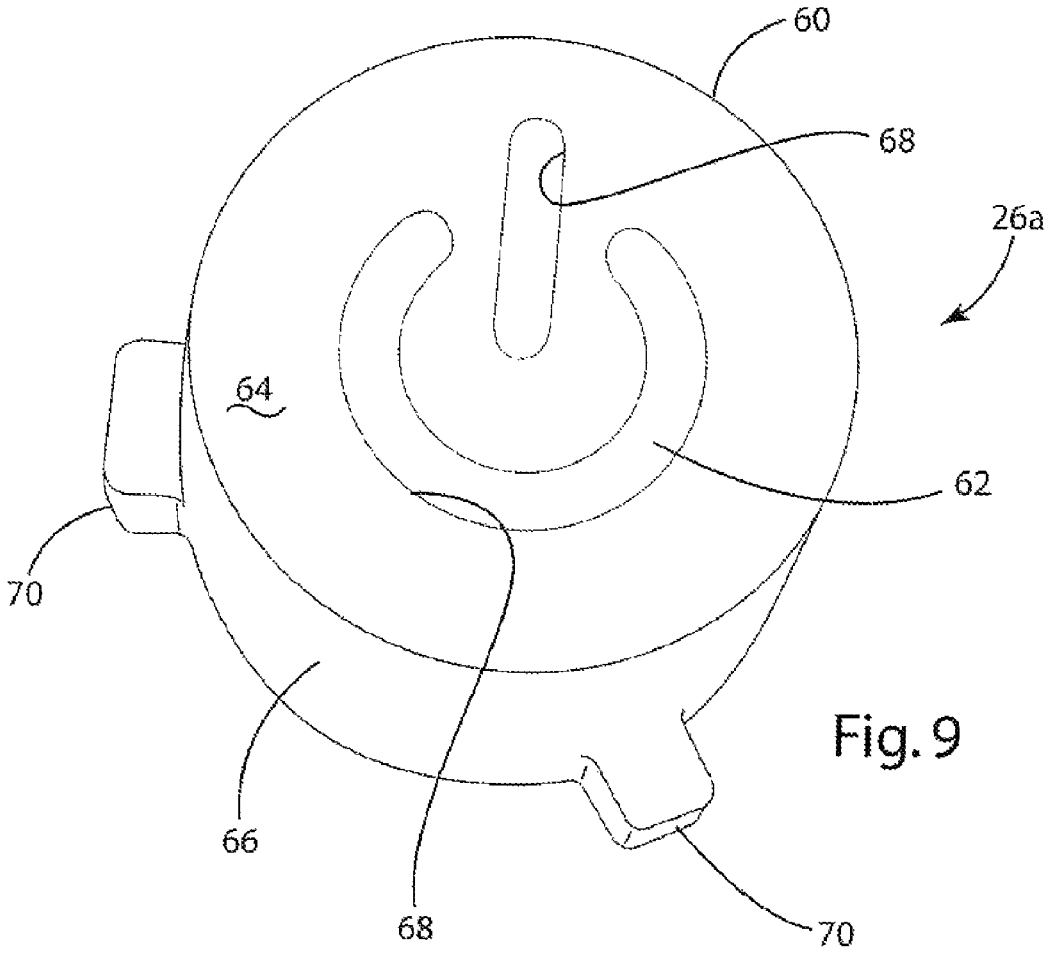
FIG. 9 is a photographs showing the front of a button.
Figure 10:
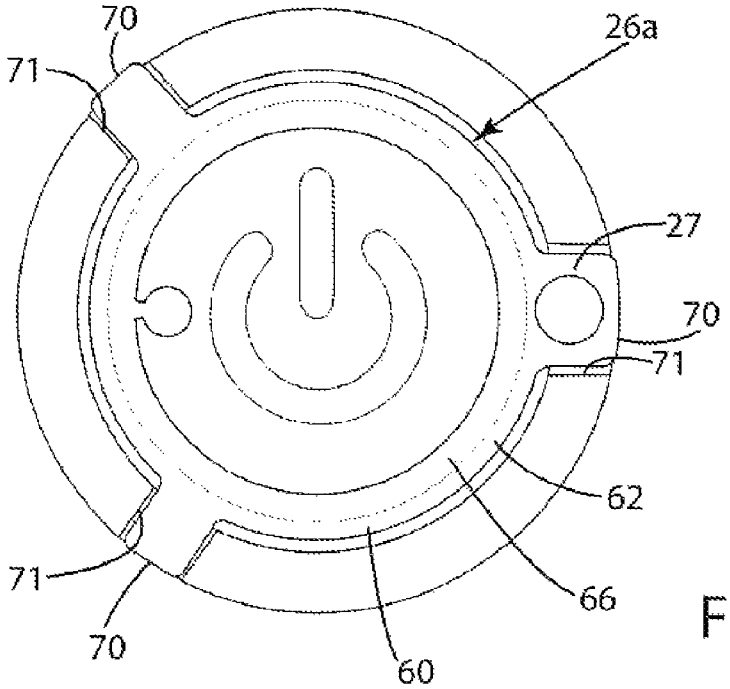
FIG. 10 is a photograph showing the rear of a button.
Figure 11:
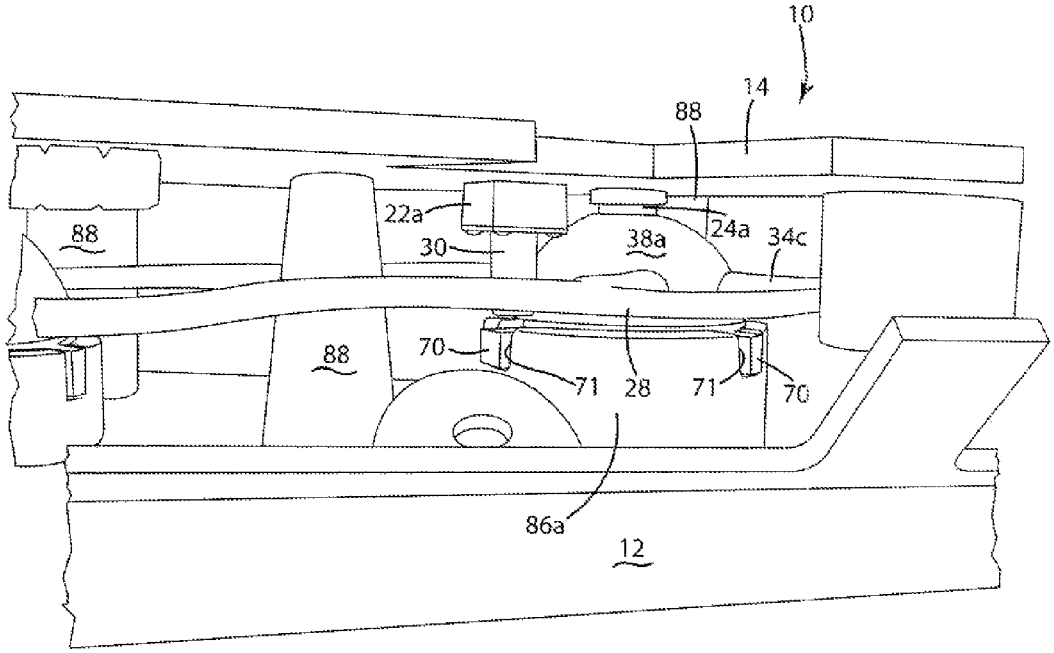
FIG. 11 is a photograph of a portion of the control panel assembly showing a single button assembly.
Figure 12:
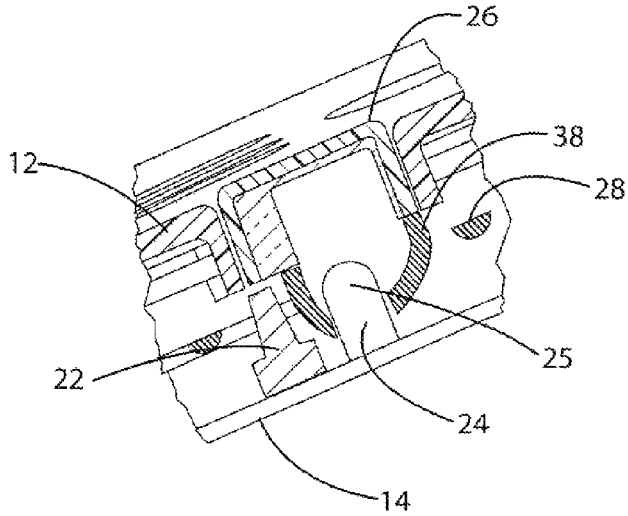
FIG. 12 is a sectional view taken through the center of a button assembly.

In the illustrated embodiment, the button 26*a* is generally conventional having an opaque portion 60 and a translucent portion 62 (See FIGS. 9 and 10). The translucent portion 62 will be illuminated by the interior light source, such as LED 24*a*. The opaque portion 60 may define one or more openings 68 that permit viewing of the translucent portion(s) 62. The translucent portion 62 may be configured to define an icon, letter(s), number(s) or other symbols. As shown, the button 26*a* may include a disc-shaped pad 64 and a rearwardly extending circumferential wall 66. The pad 64 provides a surface for pushing the button 26*a* and may also include the translucent portion 62. The button 26*a* may be manufactured using any of a variety of conventional techniques and apparatus. For example, in the illustrated embodiment, the button 26*a* is manufactured using a conventional two-shot injection molding process in which the opaque portion of the button 26*a* (with opening(s) 68) is molded in a first shot and the translucent portion 62 is molded onto the opaque portion 60 in a second shot. Alternatively, the translucent portion 62 may be defined by a separate translucent component (such as a translucent disc (not shown)) that is fitted behind the pad 64. The button 26*a* may include a plurality of tabs 70 that interface with corresponding slots 71 in the button sleeves 86*a* to ensure proper installation and alignment of the buttons 26*a* within the control panel 12. Each button 26*a-c* and button sleeve 86*a-e* may include a different pattern of tabs 70 and slots 71 to ensure that the correct button 26*a-c* is installed in the correct button opening 80*a-e* and at the correct orientation. In another alternative embodiment, the construction may be essentially reversed. In this alternative embodiment, the symbols may be defined by one or more opaque portions and the opaque portion(s) may be surrounded at least in part by one or more translucent portions.

Figure 6:
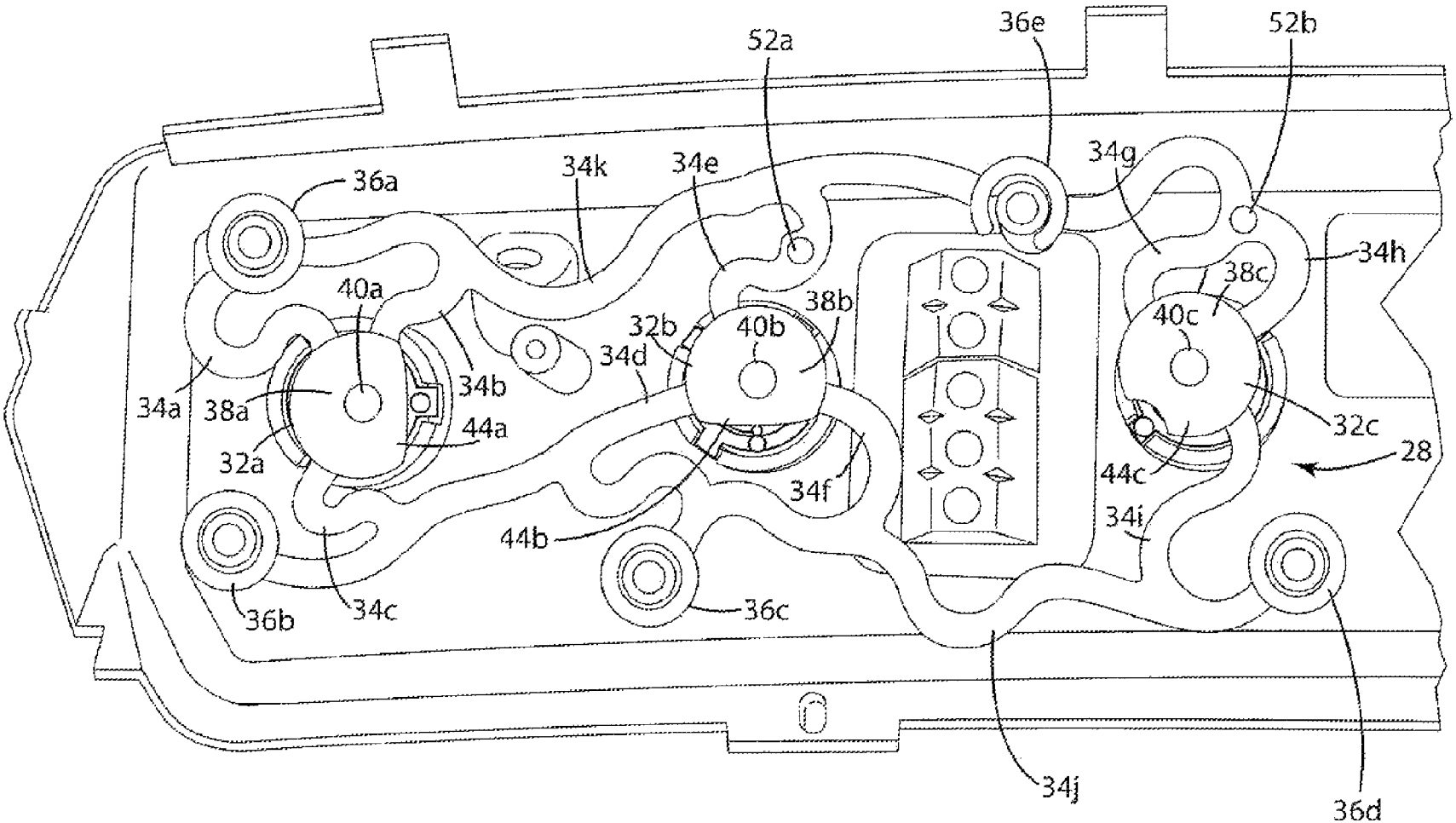
FIG. 6 is an enlarged photograph of a portion of the rear of the control panel with the buttons installed and the button spring in position.
Figure 7:
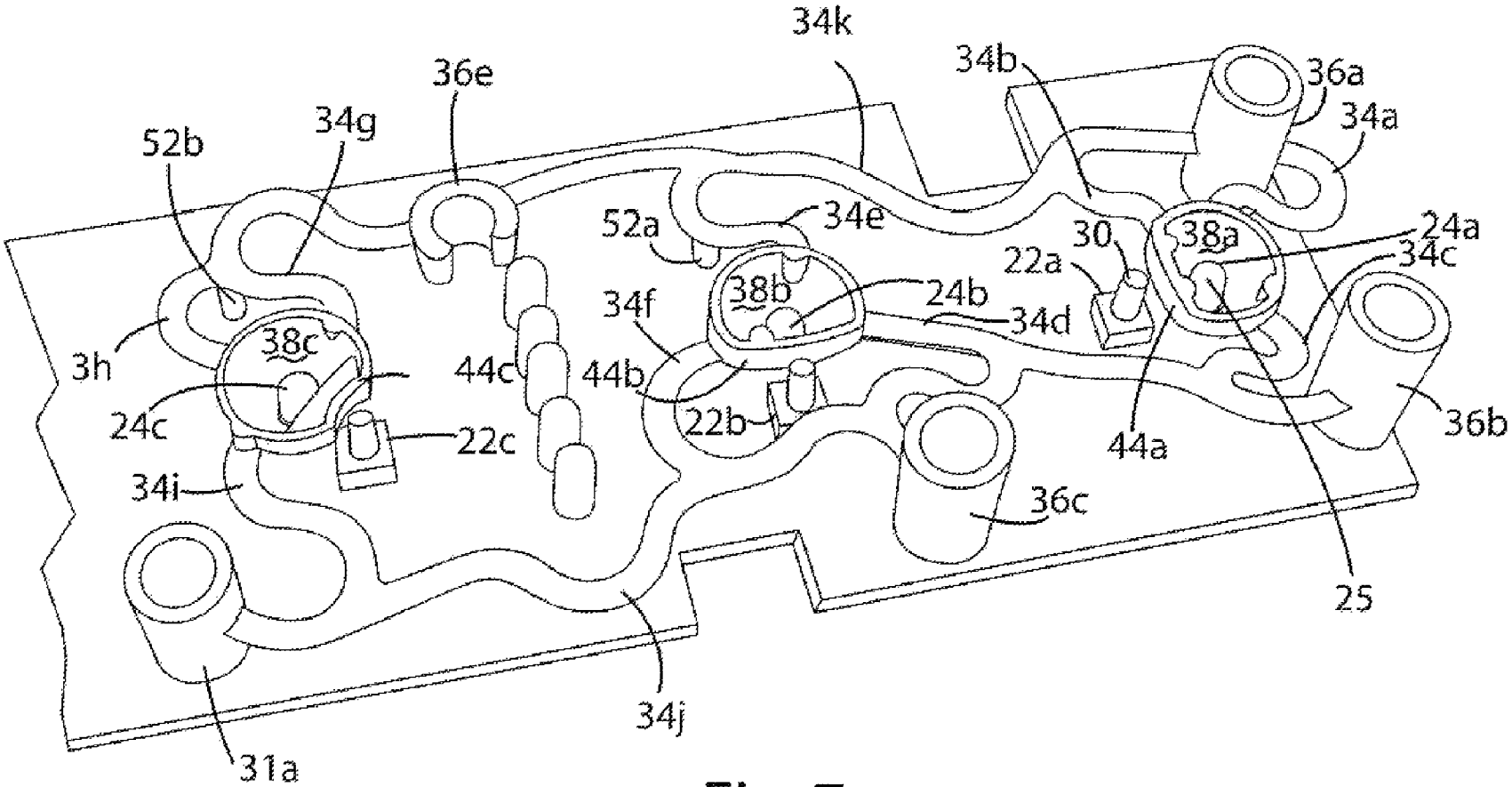
FIG. 7 is an enlarged photograph of a portion of the circuit board with the button spring in position.
Figure 8:
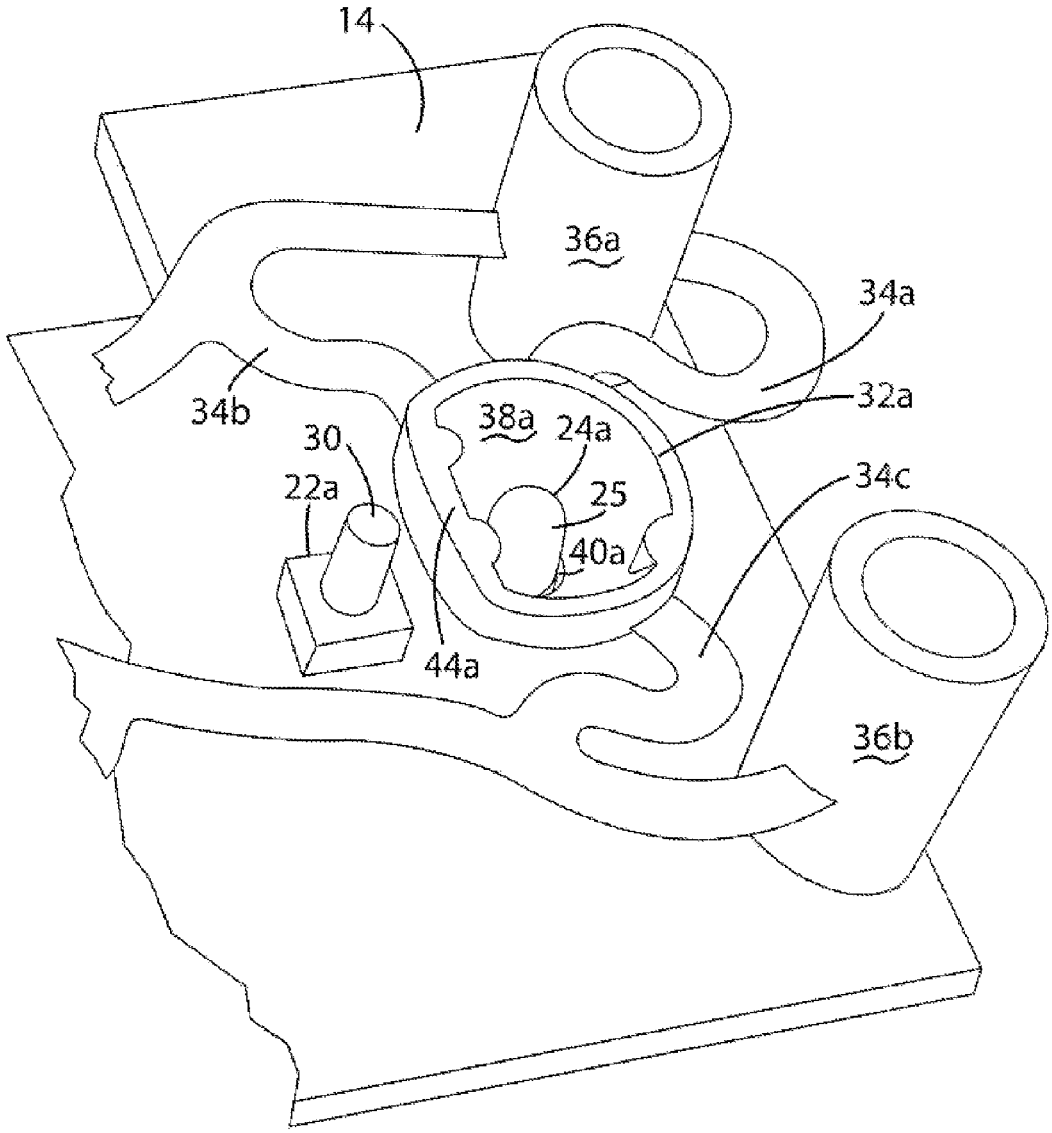
FIG. 8 is an enlarged photograph of a portion of the circuit board showing components of a single button assembly.

In this embodiment, a single button spring 28 is provided to function as a spring for all three illuminated button assemblies 16*a-c* (See FIGS. 6-8). If desired, separate button springs could be provided for each button assembly 16*a-c*

(not shown). The illustrated button spring 28 generally includes a plurality of button seats 32*a-c*, a plurality of spring arms 34*a-k* and a plurality of mounting sleeves 36*a-e*. The three button seats 32*a-c* are configured to engage the rear surface 27 of each button 26*a-c*. The seats 32*a-c* follow the general shape of the corresponding button 26*a-c* so that there is a solid contact between the seat 32*a-c* and each button 26*a-c*. In this embodiment, the rear surface 27 of each button 26*a-c* is circular. Accordingly, each seat 32*a-c* is generally circular. However, each seat 32*a-c* of the illustrated embodiment includes an irregular portion 44*a-c* to accommodate the presence of switch 22*a-c*. The size, shape and configuration of the irregular portion 44*a-c* may vary from application to application as desired—it being understood that the specific shape of the seat may impact the operation of the reflector (described below). The mounting sleeves 36*a-e* provide a structure for mounting the button spring 28 to the control panel 12 and the circuit board 14. In this embodiment, the mounting sleeves 36*a-e* are fitted over screw bosses 88 extending from the control panel 12. The button spring 28 may include full sleeves, such as sleeves 36*a-d*, or partial sleeves, such as sleeve 36*e*. The mounting sleeves 36*a-e* may be replaced by other suitable mounting elements. The spring arms 34*a-k* extend between the mounting sleeves 36*a-e* and the seats 32*a-c*. Spring arms 34*a-c* extend to seat 32*a*, support arms 34*d-f* extend to seat 32*b*, and support arms 34*g-i* extend to seat 32*c*. The spring arms 34*a-k* follow an irregular path selected to provide the spring tension that offsets or balances the force required to actuate the switch. At the same time, the spring arms 34*a-k* are configured to provide the button 26*a-c* with the appropriate tension. For example, the switch 22*a* and the spring arms 34*a-c* are located at radially symmetric positions about the seat 32*a*. It is not, however, necessary for the spring arms 34*a-k* to be spaced at radially symmetric locations. By varying the stiffness or altering the number and location of the spring arms, the button spring 28 may nonetheless provide balance against the resistance of the switch. If desired, the button spring 28 may include support posts 52*a-b* to stiffen select spring arms 34*e*, 34*g* and 34*h*. The precise size, shape and configuration of support arms 34*a-k* may vary from application to application to provide the button with the desired tension while at the same time providing the desired level of balance with the switch. In some applications, the support arms 34*a-k* may be replaced by a resilient film having the appropriate characteristics to balance out the switch and provide the desired button tension. The spring arms may also be replaced by other resilient elements. For example, the spring arms may be replaced by stretchable elastic bands (not shown) extending between the button 26*a-c* and control panel 12. As another example, the spring arms may be replaced by compressible elastic feet (not shown) extending from the circuit board 14.

In this embodiment, each seat 32*a-c* includes an integral reflector 38*a-c*. The reflectors 38*a-c* each define a central opening 40*a-c* that is fitted over the corresponding LED 24*a-c*. The opening 40*a-c* may have an inner diameter slightly larger than the outer diameter of the corresponding LED 24*a-c* to minimize light leakage. The reflectors 38*a-c* may be essentially any type of reflector. However, in one embodiment, the reflector 38*a* is configured to cooperate with the back surface of the button 26*a* to define an integrating sphere. In this embodiment, the reflectors 38*a-c* and back surfaces of the buttons 26*a-c* are diffusely reflective, and therefore provide diffuse reflection of the light. Accordingly, the integrating sphere operates to diffuse light within the integrating sphere, rather than to focus the light on the window in button 26*a*. In an integrating embodiment, the reflectors 38*a-c* may be manufactured from a material having a color that is highly reflective to the light emitted by the light source. For example, the reflectors 38*a-c* may be white or may correspond in color with the light emitted by the light source. In an alternative embodiment, the translucent layer on the inside rear of the button 26*a* may be replaced by a white material. This may improve the performance of the integrating sphere. In this alternative embodiment, a transparent or translucent window may be included within the white material to define the desired symbol.

In this embodiment, the various elements on the button spring 28 are integrally formed, for example, through a single injection molding process. The button spring 28 may be molded from ABS or other material of appropriate resiliency to provide the desired button tension. Although molded in this embodiment, the button spring 28 may be manufactured using other techniques.

Figure 13A:
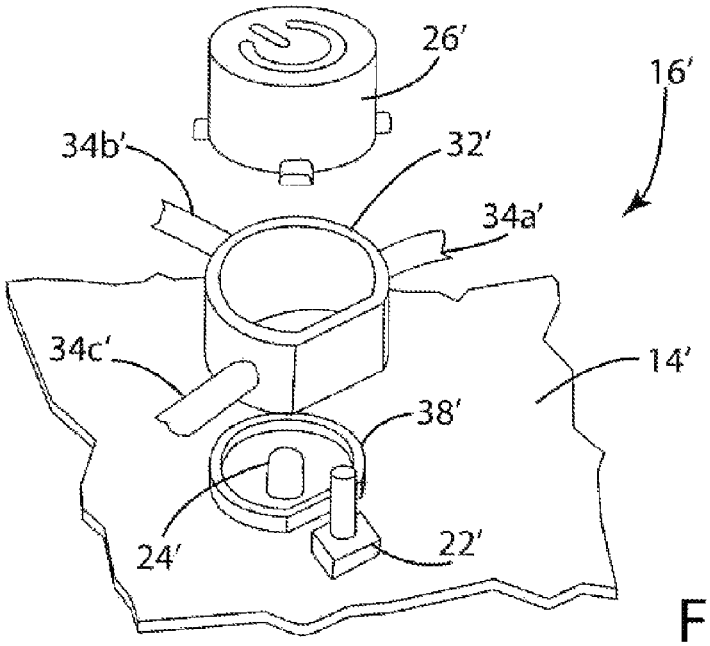
FIG. 13A is an exploded perspective sketch showing an alternative embodiment of the present invention.
Figure 13B:
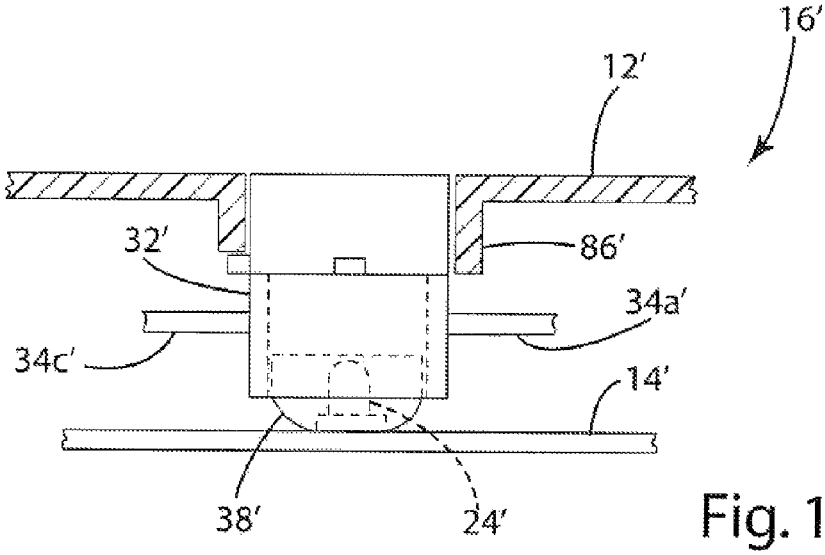
FIG. 13B is a side elevational sketch of the alternative embodiment of FIG. 13A.

In an alternative embodiment, the reflector may be separate from the button spring. A version of this alternative embodiment shown in FIGS. 13A and 13B. In the illustrated embodiment, the reflector 38' may be fixedly mounted with respect to the light source, for example, to the circuit board 14' or other support structure. In this embodiment, the reflector 38' is mounted to the circuit board 14' about the LED 24' and is configured to fit within the seat 32'. The button 26' may be mounted within the control panel 12' in button sleeve 86' in essentially the same manner as set forth above. The seat 32' is supported by spring arms 34*a-c*' that are configured to balance switch 22'. The sleeve 32' is generally tubular providing a surface to engage the button 26' while at the same time fitting around the outer diameter of the reflector 38'. This permits the seat 32' to move with respect to the fixed reflector 38' as the button 26' is operated. There may be a close fit between the reflector 38' and the seat 32' to minimize light leakage.

Figure 14:
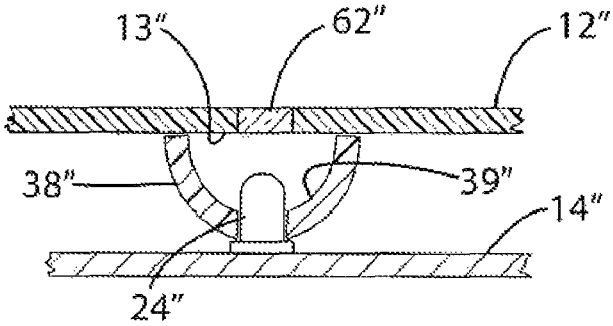
FIG. 14 is a sketch of an integrating sphere in accordance with a second aspect of the invention.
Figure 15A:
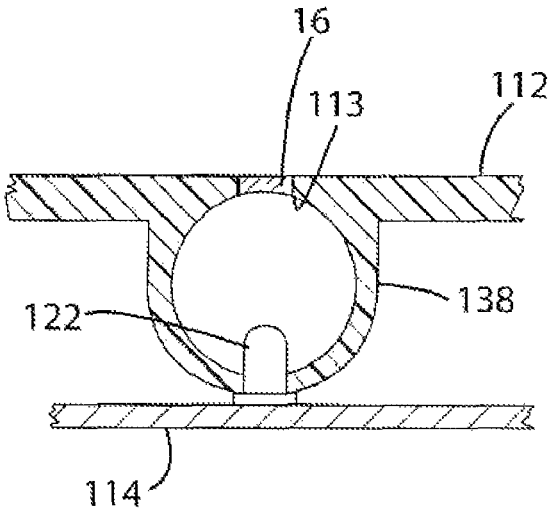
FIG. 15A is a sketch of first alternative embodiment of the integrating sphere.
Figure 15B:
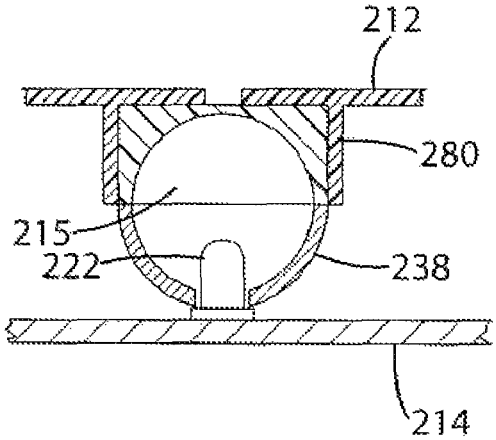
FIG. 15B is a sketch of second alternative embodiment of the integrating sphere.

If desired, an integrating sphere may be incorporated into other control panel applications where diffuse illumination is desired. For example, an integrating sphere may by incorporated into an illuminated image on a control panel even when that image is not contained within a button or other control component, such as the translucent elements 94 shown in FIG. 2. This may be particularly useful in applications where the light source is not centered behind the element to be illuminated (e.g. a translucent or transparent portion). The integrating sphere defines a generally closed space around the light source, excluding the transparent or translucent portion to be illuminated. The interior surface of the enclosed space is diffusely reflective to the light emitted by the light source. In one embodiment, the integrating sphere is defined by a reflector 38" and a portion 13" of the back surface of the control panel 12" (See FIG. 14). As shown, the reflector 38" and an LED 24" may be mounted to a circuit board 14" located behind the control panel 12". In this embodiment, the reflector 38" has a surface 39" that is diffusely reflective to the light emitted by the light source, LED 24". Similarly, the corresponding portion 13" of the back surface of the control panel 12" is diffusely reflective to the light emitted by the light source, LED 24". For example, the reflector 38" and the corresponding portion 13" of the back surface of the control panel 12" may both be white to provide diffuse reflection of all visible light. In this way, the reflector 38" and the corresponding portion 13" of the back surface of the control panel 12" will evenly distribute light within the integrating sphere and provide the transparent or translucent portion 62" with diffuse, even illumination. In some applications it may be desirable to make the interior of the integrating sphere more spherical. In an alternative embodiment shown in FIG. 15A, the reflector 138 is provide with a more spherical shape surrounding the LED 124. In this embodiment, the control panel 112 includes a spherical region 113 on its rear surface to complete the sphere. FIG. 15B shows another alternative embodiment in which a separate insert 215 is included to assist in defining the sphere around LED 222. In this embodiment, the reflector 238 defines approximately one-half of the integrating sphere. The insert 215 is mounted behind the control panel 212, for example, in a mounting sleeve 280. The entire insert 215 may be translucent (as shown) or it may include an opening or a translucent region where it is desirable for light to pass from the integrating sphere.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A control button assembly, comprising:

a control button at least a portion of which is translucent or transparent;

an integrating sphere;

a button spring;

a light source positioned behind a control button within said integrating sphere, whereby light from said light source is substantially evenly distributed throughout the integrating sphere providing substantially uniform illumination of said translucent or transparent portion;

wherein said integrating sphere includes a cup-shaped diffusely reflective surface integral with said button spring and said control button includes a diffusely reflective surface facing said light source, said cup-shaped diffusely reflective surface of said integrating sphere and said diffusely reflective surface of said control button cooperating to substantially evenly distribute light from said light source throughout said integrating sphere.

2. The control button assembly of claim 1 wherein said control button includes a translucent window through which light from within the integrating sphere can be seen, said control button further including an opaque portion surrounding said translucent portion.

3. A control button assembly, comprising:

a control button having at least a portion that is translucent;

an integrating sphere at least partially disposed behind said control button;

a light source disposed behind said control button within said integrating sphere;

a switch disposed behind said control button, said switch providing a mechanical resistance to depression of said control button;

wherein said integrating sphere includes a diffusely reflective surface facing said light source;

wherein said control button includes a diffusely reflective surface facing said light source;

wherein said light source is disposed at the approximate center of said control button; wherein said switch is disposed eccentric with respect to said control button; and further comprising a spring, said spring configured to substantially balance said mechanical resistance of said switch, thereby providing substantially uniform operation of said control button assembly;

wherein said spring includes an integral reflector, said integral reflector defining at least a portion of said integrating sphere;

wherein said integral reflector is generally cup-shaped and defines a seat engaging said control button.

4. The control button assembly of claim 3 wherein said switch is disposed outside of said integrating sphere.

5. A control panel with an illuminated control button assembly comprising:

a light source mounted to a circuit board;

a control button disposed adjacent to said light source, said control button having a translucent portion and an opaque portion, said control button having a diffusely reflective rear surface generally facing said light source;

a reflector disposed behind said control button, said reflector having a generally cup-shaped interior surface and defining a light source opening, said light source extending at least partially through said light source opening, said interior surface of said reflector being diffusely reflective;

a switch operatively engaged with said control button, whereby manual manipulation of said control button actuates said switch; and wherein said rear surface of said control button and said interior surface of said reflector cooperatively define an integrating sphere to diffusely reflect light and substantially uniformly illuminate said translucent portion of said control button.

6. The control panel of claim 5 wherein said switch is disposed eccentric with respect to said control button; and further comprising a spring, said spring configured to substantially balance said mechanical resistance of said switch, thereby providing substantially uniform operation of said control button assembly.

7. The control panel of claim 6 wherein said spring and said reflector are integral.

8. The control panel of claim 7 wherein said switch is disposed outside of said integrating sphere.

9. The control panel of claim 5 wherein said light source is further defined as an LED, said LED extending through said light source opening into said integrating sphere.

10. The control panel of claim 9 where said LED has an axis, said control button being movable with respect to said LED along said axis.

* * * * *